US006770177B2

(12) United States Patent
Keller et al.

(10) Patent No.: US 6,770,177 B2
(45) Date of Patent: Aug. 3, 2004

(54) CATHODIC PROTECTION SYSTEM FOR AIR COMPRESSOR TANKS

(75) Inventors: Charles Tillman Keller, West Chester, PA (US); William M. Lewis, Mooresville, NC (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 345 days.

(21) Appl. No.: 10/039,403

(22) Filed: Nov. 7, 2001

(65) Prior Publication Data

US 2003/0085117 A1 May 8, 2003

(51) Int. Cl.[7] ..... C23F 13/00

(52) U.S. Cl. ..... 204/196.37; 204/196.19; 204/196.21; 204/196.23; 204/196.24; 204/196.3; 204/196.31; 204/196.36

(58) Field of Search ..... 204/196.37, 196.36, 204/196.17, 196.21, 196.3, 196.31, 196.23, 196.24; 205/732, 733, 740

(56) References Cited

U.S. PATENT DOCUMENTS

| | | | | |
|---|---|---|---|---|
| 3,423,305 A | * | 1/1969 | Tausk | 204/196.15 |
| 3,978,309 A | | 8/1976 | Strobach et al. | |
| 4,013,811 A | * | 3/1977 | Maruska | 426/244 |
| 4,051,007 A | | 9/1977 | Hossle | |
| 4,087,742 A | | 5/1978 | Khoo | |
| 4,093,529 A | | 6/1978 | Strobach | |
| 4,136,001 A | | 1/1979 | Nozaki | |
| 4,848,616 A | | 7/1989 | Nozaki | |
| 5,023,928 A | | 6/1991 | Houle et al. | |
| 5,256,267 A | | 10/1993 | Roden | |
| 5,334,299 A | | 8/1994 | Roden | |
| 6,233,958 B1 | | 5/2001 | Mei et al. | |

OTHER PUBLICATIONS

M.C. Miller, Corrosion of Buried Metals and Cathodic Protection, Petroleum Engineering, Apr., May, Jun. 1944, pp. 1–10.

Corrosionsource.com–Cathodic Protection, http://www.corrosionsource.com/learingcenter/cathodic.htm, Oct. 20, 2000, pp. 1–5.

Corrosion Mechanisms, Chapter 2, http://www.corrpro.com/rcs/datasheets/primer/chapter2.pdf, Chapter2.pdf, Oct. 16, 2000 14:13, pp. 3–8.

Thomas C. Fisher, Basic Meter Hookups, Columbia Gas of Ohio, pp. 11–16, Fitzgerald, III, John H., Fundamentals of Corrosion, The Hinchman Company, pp. 17–28.

* cited by examiner

*Primary Examiner*—Bruce F. Bell
(74) *Attorney, Agent, or Firm*—Michael Best & Friedrich LLP

(57) ABSTRACT

A corrosion protection device ("CPD") for inhibiting corrosion of an air compressor collection tank, and relieving the pressure in the tank when excessive condensate accumulates within the tank. A relief passage extends through the plug, and an anode seals the relief passage near the interior volume of the tank. The tank, plug and anode are all coupled in an electrically conductive relationship, and a galvanic circuit is formed when condensate collects near the bottom of the tank. The anode has a lower redox potential than steel, and is preferably made from magnesium. The anode loses electrons with less resistance than the steel tank, so the anode will be consumed through the oxidation process before the steel tank corrodes. Once the anode is consumed so that it no longer seals the relief passage, the condensate and air are discharged from the tank through the relief passage.

48 Claims, 7 Drawing Sheets

CATHODIC PROTECTION SYSTEM FOR AIR COMPRESSOR TANKS

FIELD OF THE INVENTION

This invention relates generally to compressor tanks, and more particularly to corrosion protection systems for compressor tanks.

BACKGROUND OF THE INVENTION

Corrosion is a concern for compressor tanks. Compressor tanks are commonly made from metal, or other materials that are susceptible to corrosion. The threat of corrosion is greatest near the bottom of a compressor tank where condensation can accumulate. The condensate within the tank can corrode the interior surface of the tank wall and reduce the wall thickness of a portion of the tank. The contents of a compressor tank are under pressure. If the wall thickness of the tank is decreased and the tank wall is weakened, the tank may fail.

Compressor tanks are generally equipped with a let down valve to periodically drain condensate moisture is a gas and is not drained. It can "escape" when the valve is opened from the tank, but a tank rupture may still occur if the let down valve is not used sufficiently frequently. Additionally, it is difficult to determine the amount of corrosion that has occurred in a tank. Even if the condensate is drained from a tank, a significant amount of corrosion may have occurred before the draining. Further corrosion may cause a tank rupture.

SUMMARY OF THE INVENTION

The invention comprises a corrosion protection device for an air compressor tank to prevent tank failures. A feature of the corrosion protection device is to inhibit corrosion of the tank caused by condensate that has accumulated in the tank. The tank has a tank wall defining an enclosed interior volume, and a tank opening in the tank wall. The corrosion protection device comprises a plug that is removably positioned in the tank opening to close the tank and seal the interior volume. A relief passage extends through the plug, and at least a portion of an anode closes the relief passage. The anode, plug, and tank are all coupled in an electrically conductive relationship.

The corrosion protection device is disposed near the bottom of the tank where condensate is most likely to accumulate. The plug has a let down valve that may be opened to release condensate and pressure from within the tank. If the let down valve is not utilized sufficiently frequently, condensate may accumulate and corrode the materials it comes in contact with. The anode has a lower redox potential than the tank, and corrodes at a faster rate than the tank corrodes. Compressor tanks are generally made of steel, and the anode may be made of magnesium. The anode is more likely than the tank to lose electrons and corrode, so the anode inhibits corrosion of the tank by corroding before the tank corrodes. After corrosion has consumed a sufficient portion of the anode to open the relief passage, the moisture and pressure within the tank are released through the relief passage. A consumed anode may be replaced by a new anode, and the tank may then be reused.

Figure 1:
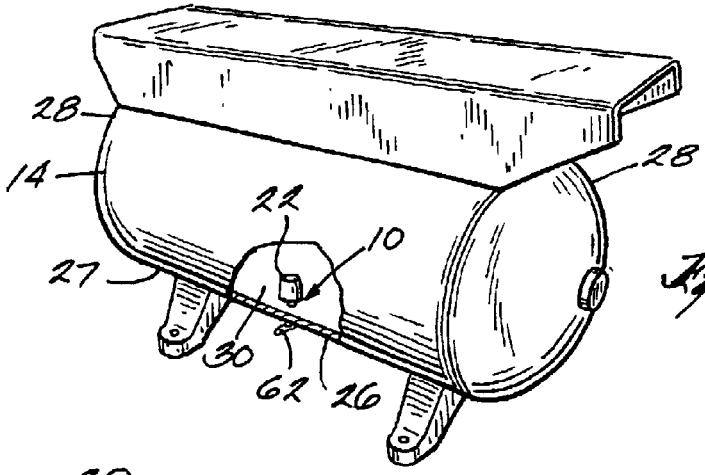
FIG. 1 is a perspective view of a compressor tank embodying the invention and including a corrosion protection device.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1–4 illustrate a corrosion protection device ("CPD") 10 that is designed to prevent corrosion of a compressor tank 14. The illustrated CPD 10 uses cathodic corrosion protection to inhibit condensate from corroding the interior surface of a compressor tank 14. The CPD 10 includes a plug 18 and a sacrificial anode 22.

Figure 13:
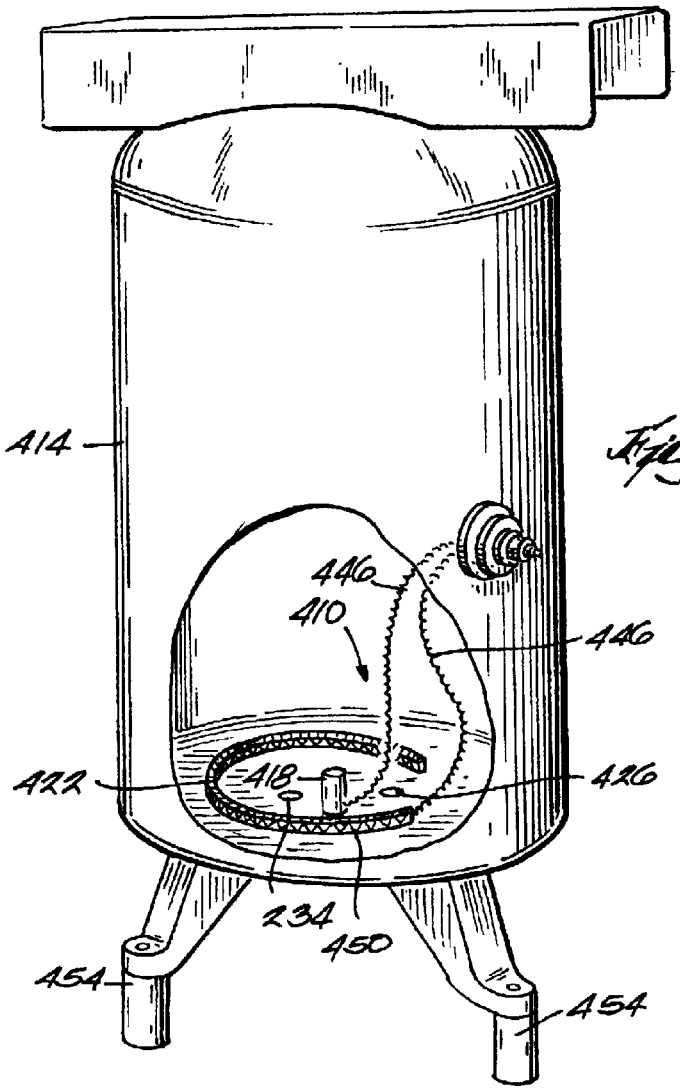
FIG. 13 is a perspective view of a compressor tank showing a fifth embodiment of a corrosion protection device.

FIG. 1 illustrates a compressor tank 14 for storing pressurized air from an air compressor. The contents of the tank 14 are generally under pressure, and the tank 14 has tank walls 26 of sufficient strength to retain the compressed air. Compressor tanks are commonly made from steel, or similar materials. In FIG. 1, the tank 14 has an elongated cylindrical shell 27 and rounded ends 28. The rounded ends 28 are generally welded to the cylindrical shell 27. The tank 14 generally defines an interior volume 30 within the tank 14 that is separated from the exterior atmosphere outside of the tank 14. The tank 14 may be positioned horizontally, as shown in FIG. 1, or vertically, as shown in FIG. 13. The CPD 10 may be used in both a horizontal or vertical tank.

Moisture and condensation may collect within the tank 14, and the condensate generally collects near the lowest point of the tank 14. Condensate corrodes steel through the electrochemical process of oxidation, or rust, in which electrons flow from the iron particles in the steel to hydrogen particles in the condensed water. The loss of electrons alters the composition of the iron and may reduce the thickness of the tank wall 26, which weakens the tank wall 26 and increases the possibility of a tank failure.

In FIG. 1, the CPD 10 is generally located near the lowest portion of the tank 14 where the condensate collects. In a horizontal tank, the CPD 10 may be interconnected to the cylindrical shell 27. In a vertical tank, the CPD 10 may be interconnected to a rounded end 28.

Figure 2:
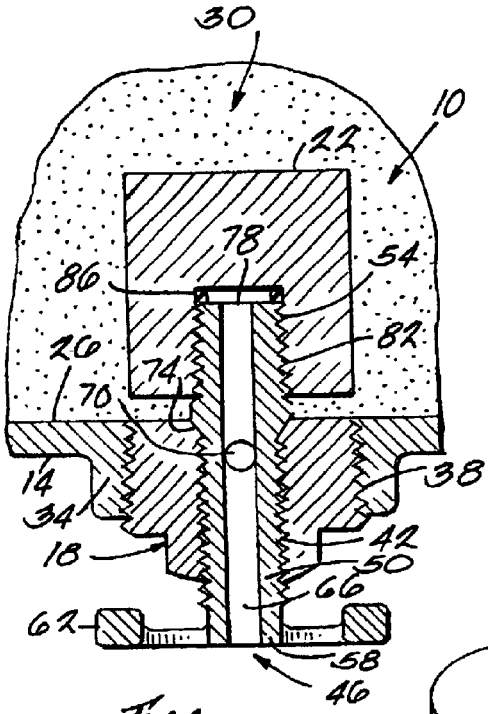
FIG. 2 is an enlarged cross-sectional view of the corrosion protection device shown in FIG. 1 and having an unconsumed anode.
Figure 3:
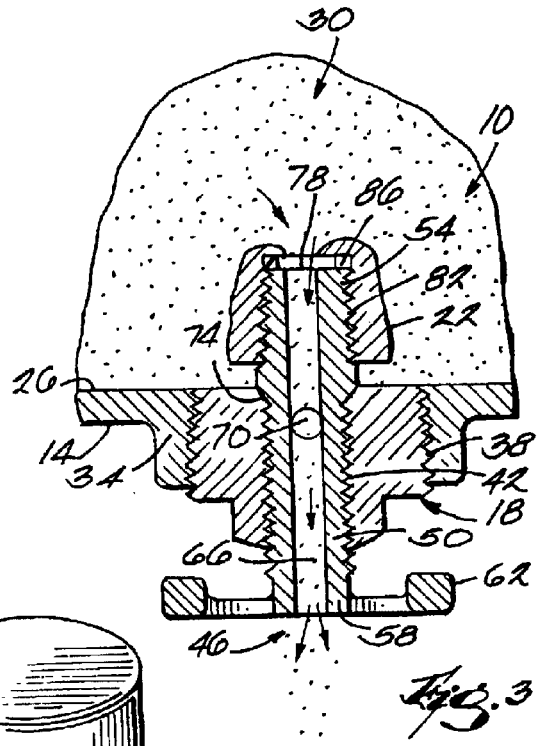
FIG. 3 is a cross-sectional view of the corrosion protection device shown in FIG. 2 and having a consumed anode.
Figure 4:
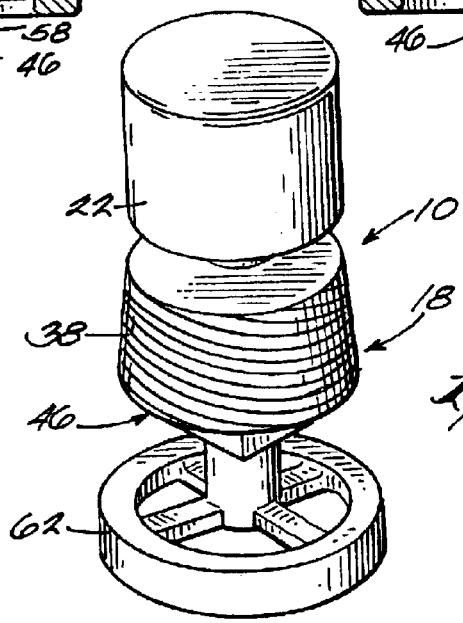
FIG. 4 is a perspective view of the corrosion protection device of FIG. 2.

The CPD 10 may inhibit corrosion of the steel tank 14 wall by providing a galvanic corrosion circuit between the tank 14, the CPD 10 and the liquid condensate. As illustrated in FIGS. 2–4, the tank 14 and the CPD 10 are coupled in an electrically conductive relationship, and the liquid condensate acts as an electrolyte to complete the electrical connection for a galvanic circuit. A galvanic circuit is formed when two dissimilar metals form an electrical circuit connection. Generally, the more active metal in the circuit becomes the anode and corrodes, and the less active metal becomes the cathode and is protected. The anode is generally the site where the oxidation, or loss of electrons occurs. The CPD 10 uses cathodic corrosion protection to help prevent tank 14 corrosion by concentrating corrosion at the sacrificial anode 22 and suppressing corrosion at the steel tank 14.

The sacrificial anode 22 is made from a material that is more active, and more susceptible to oxidation than iron, or steel. A redox potential value for a material represents the potential for reaction of the material. The redox potential scale is based on a materials reactiveness in relation to hydrogen, so hydrogen has a redox potential of 0.00. A redox potential below 0.00 means the material is more reactive than hydrogen, and a redox potential above 0.00 means the material is less reactive than hydrogen. A material having a lower negative value for a redox potential is more active, and is more likely to lose electrons, than a material with a higher redox potential. The sacrificial anode 22 should have a redox potential that is lower than the redox potential of the steel tank 14, which generally includes iron. Therefore, the sacrificial anode 22 is more likely to lose electrons than the steel tank 14. Table 1 illustrates the redox potential (in volts) of some common materials:

TABLE 1

| Material | Redox Potential |
|---|---|
| Magnesium (Mg) | −2.38 |
| Aluminum (Al) | −1.66 |
| Zinc (Zn) | −0.76 |
| Iron (Fe) | −0.44 |

TABLE 1-continued

| Material | Redox Potential |
|---|---|
| Nickel (Ni) | −0.23 |
| Hydrogen (H) | 0.00 |
| Copper (Cu) | +0.34 |
| Silver (Ag) | +0.80 |
| Gold (Au) | +1.42 |

As illustrated in Table 1, magnesium has a lower redox potential (−2.38) than iron (−0.44), so magnesium is more likely to corrode and lose electrons than iron. In the illustrated embodiment, the sacrificial anode 22 may be made from magnesium to provide cathodic corrosion protection for the steel tank 14. If liquid condensate collects at the bottom of the tank 14, the magnesium sacrificial anode 22 is more likely than the steel tank 14 to lose electrons and corrode in the galvanic circuit. Because the anode 22 is more likely to corrode, the steel tank 14 may retain its electrons and maintain a substantially constant chemical composition and tank wall 26 thickness. The sacrificial anode 22 provides two vital functions. One, the anode 22 concentrates the corrosion at the anode 22 not the tank wall 26, and two, the anode 22 indicates when the anode 22 has become depleted so the anode 22 can be replaced for future tank protection.

Some factors that may affect the effectiveness of the CPD 10 are the size and surface area of the anode 22. A larger anode 22, offers more electrons for oxidation and generally lasts longer than a smaller anode 22. The reactiveness of the anode 22 is also limited by its surface area. A reaction can only take place where the condensate contacts the anode 22. Therefore, an anode 22 with a larger surface area is capable of reacting with more condensate. A larger anode 22 will generally also have a larger surface area. Additionally, the smooth surface of the anode 22 may be disrupted by rolled or machined grooves, knurling, or other techniques designed to increase the surface area of the anode 22.

An additional factor is that the redox potential of some materials may change depending on the conditions, such as temperature. For example, zinc and iron may switch positions at higher temperatures, and the redox potential of zinc may actually be above the redox potential of iron. The redox potential of zinc may change at approximately 150 degrees Fahrenheit. Therefore, zinc may not be an effective material for the anode 22 if the CPD 10 will be exposed to elevated temperatures. Temperatures within an air compressor tank may reach 400 degrees Fahrenheit.

Another factor that impacts the effectiveness of the of the CPD 10 is the size of the tank 14. The CPD 10 may only protect the tank 14 from corrosion in a limited area near the CPD 10. A larger anode 22 may be used in a larger tank 14 with more condensation and a larger surface area near the bottom of the tank 14. As described below, various configurations and embodiments of the CPD 10 may be used for tanks of various sizes and arrangements.

In the embodiment of the invention shown in FIGS. 2–4, the CPD 10 comprises the plug 18 and the anode 22. The plug 18 may be inserted into a tank opening 34 to seal the tank 14. The plug 18 has a substantially cylindrical, or tubular shape, and has an outer surface 38 and inner surface 42. The outer surface 38 and inner surface 42 are both threaded, and the outer surface is threadedly engaged with the tank opening 34. The plug 18 is made from an electrically conductive material, and is coupled to the tank 14 in an electrically conductive relationship. The plug 18 is preferably made from brass, copper, or a similar electrically conductive metal that has a higher redox potential than the anode 22.

In the illustrated embodiment, the outer surface 38 has a left-hand thread to prevent the plug 18 from being easily replaced, or defeated, by a conventional right-hand threaded plug, bolt, or other threaded member. The tank opening 34 also has a left-hand thread to accommodate the plug 18. The left-hand thread decreases the likelihood that a conventional right-hand thread plug or bolt is intentionally, or accidentally, inserted into the tank opening 34, in place of the CPD 10.

The plug 18 may also include a let down valve 46 that is threadedly engaged with the inner surface 42. The let down valve 46 should be opened periodically to discharge accumulated moisture from the tank 14. Corrosion of the tank 14 may be minimized by regularly discharging the let down valve 46. The CPD 10 is intended to provide additional protection in case the let down valve 46 is not utilized sufficiently frequently.

As shown in FIGS. 2 and 3, the let down valve 46 has an elongated cylindrical stem 50 that is at least partially disposed within the plug 18. The stem 50 is threaded and engages the inner surface 42 of the plug 18. The stem 50 has a interior end 54 disposed within the interior volume 30 of the tank 14, and an exterior end 58 disposed at the end of the stem 50 opposite the interior end 54. A handle 62 is coupled to the exterior end 58 of the stem 50. The let down valve 46 may be moved by rotating the handle 62 to thread the stem 50 inwardly toward the interior volume 30, or outwardly away from the interior volume 30.

A relief passage 66 extends through the stem 50 near the longitudinal axis of the stem 50. A let down aperture 70 is in fluid flow communication with the relief passage 66, and extends outwardly from the relief passage 66 through the stem 50 in a direction substantially transverse to the relief passage 66. A let down seal 74 is disposed around the stem 50 near the intersection of the stem 50 and the plug 18, adjacent the interior volume 30. The let down aperture 70 is offset from the let down seal 74, near the side of the let down seal 74 closest to the exterior end 58 of the stem 50.

The let down valve 46 may be moved between an open position and a closed position. FIG. 2 illustrates the let down valve 46 in the closed position. When the let down valve 46 is in the closed position, the let down seal 74 contacts the plug 18 to create a seal between the stem 50 and the plug 18, and the let down aperture 70 is not exposed to the interior volume 30. The let down valve 46 may be moved to the open position by rotating the handle 62 and threading the stem 50 inwardly toward the interior volume 30, thereby separating the let down seal 74 from the plug 18.

The let down valve 46 is in the open position when the stem 50 is threaded inwardly far enough to expose the let down aperture 70 to the interior volume 30. When the let down valve 46 is in the open position, accumulated condensate within the tank 14 may be discharged from the interior volume 30 into the outside atmosphere through the let down aperture 70 and relief passage 66. Since the contents of the tank 14 are usually under pressure, the pressure within the tank 14 forces the condensate and moisture out the let down valve 46 and into the atmosphere. Once the condensate is discharged, the let down valve 46 may be returned to the closed position to reseal the tank 14.

As shown in FIG. 2, the interior end 54 of the stem 50 extends into the interior volume 30. A relief aperture 78 is an opening of the relief passage 66 near the interior end 54. The anode 22 is coupled to the stem 50 near the interior end 54, and seals the relief aperture 78. The anode 22 is generally cylindrical and has an inner bore 82 that extends into the anode 22, but not completely through the anode 22. As illustrated in FIG. 2, the surface of the inner bore 82 is threaded, and the anode 22 is interconnected to the stem 50 near the interior end 54. An O-ring 86 or washer may be placed between the anode 22 and the interior end 54 to improve the seal between the anode 22 and stem 50.

The threaded coupling between the stem 50 and the anode 22 permits the anode 22 to be easily removed and replaced. As described below, a consumed anode 22 may be removed from the stem 50 and replaced by a new anode 22. As illustrated in FIGS. 2 and 4, the diameter of the new anode 22 is smaller than the diameter of the plug 18 to permit the anode 22 to be inserted into the interior volume 30 when the plug 18 is threaded into the tank opening 34.

Alternatively, the anode 22 may be sealed to the stem 50 through other means, such as a sealant, adhesive, or epoxy. In this alternate embodiment, the anode 22 is still in an electrically conductive relationship with the stem 50, and the anode 22 seals the relief aperture 78. The anode 22 functions similarly to the previously described embodiment illustrated in FIGS. 2–4, and corrodes before the tank 14 corrodes to expose the relief aperture 78 after sufficient condensate has accumulated.

As described above, the anode 22 may be made from a material having a redox potential lower than the redox potential of iron, and the anode 22 is preferably made from magnesium. The CPD 10 is preferably disposed near the bottom of the tank 14 where moisture generally collects. The tank 14 may be tilted to ensure that the condensate collects near the CPD 10 and contacts the anode 22 to form a galvanic circuit.

The anode 22 provides electrons with less resistance than the tank 14, stem 50 or plug 18, because the anode 18 is more active and has a lower redox potential than the tank 14, stem 50 or plug 18. Therefore, the anode 22 may lose electrons and corrode faster than the tank 14 loses electrons and corrodes. If the anode 22 continues to corrode and lose electrons, it will eventually become consumed, or corroded to the point where the relief aperture 78 is exposed to the interior volume 30. Once the anode 22 is consumed, the relief passage 66 is in fluid flow communication with the interior volume 30. FIG. 2 illustrates the CPD 10 with a new, or unconsumed anode 22, and FIG. 3 illustrates the CPD 10 with a consumed anode 22.

As illustrated in FIG. 3, once the anode 22 is consumed, the condensate within the tank 14 may be discharged from the tank 14 through the relief passage 66. Arrows in FIG. 3 represent the flow path of the condensate from the interior volume 30 to the outside atmosphere. Similar to the let down valve 46, the pressure within the tank 14 forces the moisture and condensate through the relief passage 66 and out of the tank 14. The anode 22 and relief passage 66 function similarly to the let down valve 46, except that the anode 22 and relief passage 66 automatically relieve pressure and release the moisture and condensate after enough condensate has accumulated to consume the anode 22.

Once the anode 22 is consumed, the condensate and air being discharged through the relief passage 66 create an audible noise that a person can identify. The noise generated by this air discharge indicates that the compressor should be shut down because the pressure is being relieved and the compressor tank 14 will no longer function effectively. The plug 18 can then be removed from the tank opening 34 and the consumed anode 22 may be disconnected from the stem 50. A new anode 22 may be placed onto the stem 50 before the plug 18 is inserted back into the tank opening 34 to reseal the tank 14.

As mentioned above, a feature of the CPD 10 is to prevent tank ruptures caused by corrosion of the tank walls 26 while the contents of the tank 14 are under pressure. Since the anode 22 may be consumed before the tank 14 corrodes, the CPD 10 discharges the condensate and pressure within the tank 14 before the tank 14 may corrode enough to cause a rupture. Therefore, the pressure within the tank 14 is released through the relief passage 66 and the tank 14 may not rupture after the anode 22 is consumed enough to expose the relief passage 66.

A feature of any embodiment of the CPD 10 is that the wall thickness of the protected tank walls 26 can be reduced as compared to the thickness of conventional tank walls because the CPD 10 inhibits tank wall 26 corrosion. The tank walls 26 must be made thick enough to provide enough strength to retain the tank pressure. Conventional tank walls must also be made thick enough to compensate for the effects of corrosion which reduce the wall thickness and weaken the tank 14. Therefore, in order to prevent a tank rupture, conventional tank walls must generally be made thicker than is necessary to retain the high pressure contents, because tank 14 corrosion must be taken into consideration when determining wall thickness.

Since the CPD 10 inhibits tank 14 corrosion, a tank 14 with a CPD 10 may have a tank wall 26 thickness that is less than the wall thickness of a comparable conventional tank without a CPD 10. Reducing the tank wall thickness 26 of the tank 14 can provide several cost savings, including reduced material and manufacturing costs. The CPD 10 has permitted the tank wall 26 thickness to be reduced as much as 30% from previous conventional tanks. In addition, since the CPD 10 inhibits tank 14 corrosion instead of merely indicating when corrosion has occurred, the tank 14 may be reused after a consumed anode 22 is replaced on the CPD 10.

Figure 5:
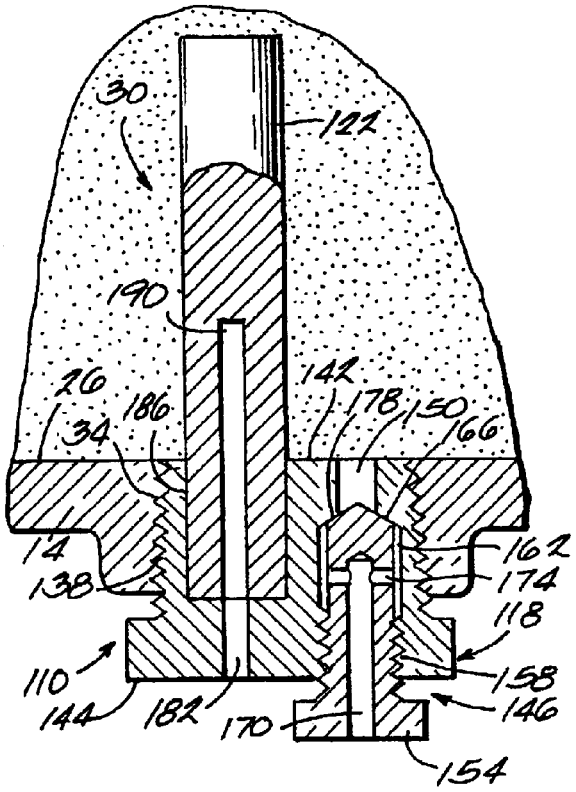
FIG. 5 is a view similar to FIG. 2 and showing a second embodiment of a corrosion protection device and having an unconsumed anode.
Figure 6:
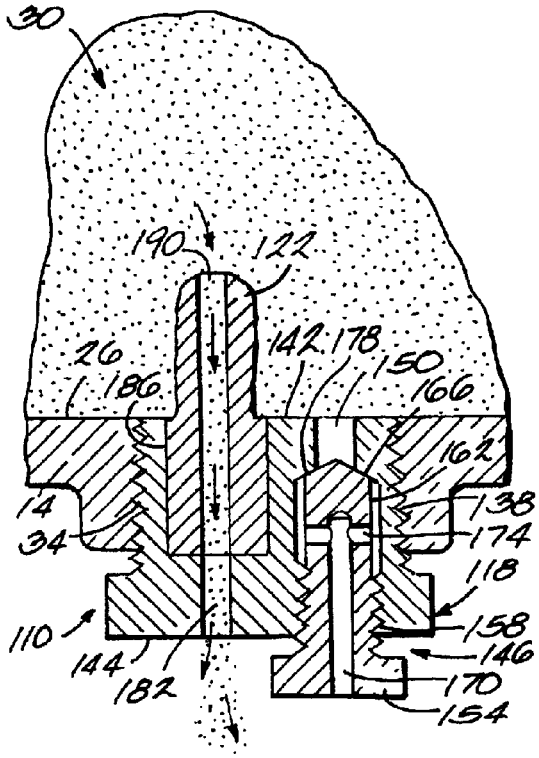
FIG. 6 is a cross-sectional view of the corrosion protection device of FIG. 5 and having a consumed anode.
Figure 7:
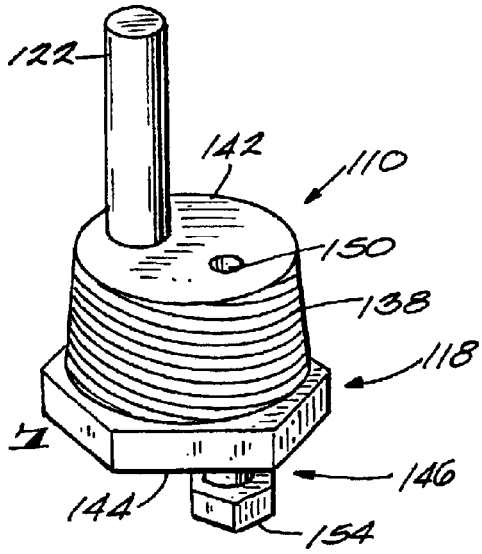
FIG. 7 is a perspective view of the corrosion protection device of FIG. 5.

FIGS. 5–7 illustrate a second embodiment of the invention that includes a CPD 110 having a plug 118 and an anode 122. The plug 118 may be inserted into the tank opening 34 to seal the tank 14. The plug 118 has a substantially cylindrical shape, and has a threaded outer surface 138 that engages the tank opening 34. The plug 118 is made from an electrically conductive material, and is preferably made from brass, copper, or a similar electrically conductive metal material that has a higher redox potential than the anode 122. Similar to the first embodiment, the plug 118 in the second embodiment has a left-hand thread on the outer surface 138 to help prevent the plug 118 from being accidentally, or intentionally, replaced by a conventional right-hand thread plug, bolt, or other threaded member.

The plug 118 shown in FIGS. 5–7 has an interior end 142 facing the interior volume 30, and an exterior end 144 facing the outside atmosphere, in a direction opposite the interior end 142. The plug 118 has a let down valve 146 that includes a let down passage 150 extending through the plug 118, and a valve member 154 at least partially disposed within the let down passage 150. The let down passage 150 has a threaded portion 158 near the exterior end 144 and a chamber 162 near the middle portion of the let down passage 150. The valve member 154 may be shaped similarly to a bolt, and may be threaded to engage the threaded portion 158 of the let down passage 150. A valve seal 166 is located at the end of the valve member 154 disposed within the let down passage 150.

A valve bore 170 extends into the valve member 154 near the longitudinal axis of the valve member 154, but the valve bore 170 does not extend completely through the valve seal 166. An auxiliary passage 174 is in fluid flow communication with the valve bore 170, and extends through the valve member 154 in a direction substantially transverse to the valve bore 170. The auxiliary passage 174 is also in fluid flow communication with the chamber 162. As illustrated in FIGS. 5 and 6, the surface of the chamber 162 is separated from the adjacent portion of the valve member 154 to permit gas or fluid to flow through the chamber 162 and into the auxiliary passage 174.

The let down valve 146 is movable between an open position and a closed position. FIGS. 5 and 6 illustrate the let down valve 146 in the closed position. When the let down valve 146 is in the closed position, the valve seal 166 contacts an end surface 178 of the chamber 162 to seal the let down passage 150. To move the let down valve 146 into the open position, the valve member 154 may be threaded outwardly, or away from the interior volume 30.

When the let down valve 146 is in the open position, the valve seal 166 is separated from the end surface 178. The accumulated condensate within the tank 14 may be discharged from the interior volume 30 and into the outside atmosphere through the let down valve 146. The condensate and moisture passes through the let down passage 150, into the chamber 162, through the auxiliary passage 174, and out the valve bore 170 to reach the outside atmosphere. Since the contents of the tank 14 are usually under pressure, the pressure within the tank 14 forces the moisture and condensate through the let down valve 146 and into the atmosphere. Once the condensate is discharged, the let down valve 146 may be returned to the closed position to reseal the tank 14.

As shown in FIGS. 5 and 6, the plug 118 has a relief passage 182 that is separate from the let down valve 146. The relief passage 182 extends through the plug 118 from the interior end 142 to the exterior end 144. The relief passage 182 has a counter-bore 186 near the interior end 142, and the diameter of the counter-bore 186 may be greater than the diameter of the remaining portion of the relief passage 182. The anode 122 may be inserted into the counter-bore 186 to create a seal between the anode 122 and the plug 118. In FIGS. 5–7, the anode 122 is at least partially disposed within the counter-bore 186, and projects from the interior end 142 of the plug 118 into the interior volume 30. An anode bore 190 extends into the anode 122 from the end of the anode 122 near the plug 118, and the anode bore 190 may be aligned with the relief passage 182.

The CPD 110 of the second embodiment, illustrated in FIGS. 5–7, functions very similarly to the CPD 10 of the first embodiment, illustrated in FIGS. 1–4. These embodiments use the anode 22, 122 and cathodic corrosion protection to relieve accumulated condensate and inhibit corrosion of the tank 14. The primary difference between these embodiments, as well as other embodiments, is the configuration of the plug 18, 118 and the anode 22, 122. The electrochemical process involving the anode 22, 122 and the tank 14 will be similar in any of the embodiments.

As described above and illustrated in FIGS. 5–7, the anode 122 is made from a material having a redox potential lower than the redox potential of iron, and the anode 122 is preferably made from magnesium. Similar to the first embodiment, the CPD 110 is disposed near the bottom of the tank 14 where condensate generally collects, and the tank 14 may be tilted to ensure that the condensate collects near the CPD 110. As condensate collects and contacts the anode 122, a galvanic circuit is formed, and electrons are transferred from the anode 122 to hydrogen in the water condensate. Since the anode 122, plug 118, and tank 14 are all coupled in an electrically conductive relationship, the water will first take electrons from the source that provides the electrons with the least resistance.

The anode 122 provides electrons with less resistance than the tank 14 or plug 118, because the anode 122 is more active and has a lower redox potential than the tank 14 or plug 118. Therefore, the anode 122 may provide electrons and corrode before the tank 14 begins to lose electrons and corrode. If the anode 122 continues to corrode and lose electrons, it will eventually become consumed, or corroded to the point where the anode bore 190 is exposed to the interior volume 30, and the anode bore 190 is in fluid flow communication with the interior volume 30. FIG. 5 illustrates the CPD 110 with a new unconsumed anode 122, and FIG. 6 illustrates the CPD 110 with a consumed anode 122.

As illustrated in FIG. 6, once the anode 122 is consumed, the condensate within the tank 14 may be forced out of the tank 14 through the anode bore 190 and relief passage 182. Arrows in FIG. 6 represent the flow path of the moisture and condensate from the interior volume 30 to the outside atmosphere after the anode 122 has been consumed. Similar to the let down valve 146, the pressure within the tank 14 forces the moisture and condensate through the relief passage 182 and out of the tank 14. The anode 122 and relief passage 182 function similar to the let down valve 146, except that the anode 122 and relief passage 182 automatically release the condensate after enough condensate has accumulated to consume the anode 122.

Once the anode 122 has been consumed, the condensate and air being discharged through the relief passage 182 will create a tell-tale noise that a person can identify. The tell-tale noise indicates that the machine should be shut down because the compressor tank 14 will no longer function effectively with the pressure being relieved. The plug 118 can then be removed from the tank opening 34, and the consumed anode 122 may be removed from the plug 118. A new anode 122 may then be placed into the plug 118 before the plug 118 is reinserted back into the tank opening 34 to reseal the tank 14.

As mentioned above, a feature of the CPD 110 is to prevent tank failures caused by corrosion of the tank walls 26 while the contents of the tank 14 are under pressure. Since the anode 122 may be consumed before the tank 14 corrodes, the condensate and pressure are discharged through the relief passage 182 before the tank 14 corrodes enough to cause a rupture. Therefore, the pressure within the tank 14 is released through the relief passage 182 and the tank 14 will not rupture after the anode 122 is consumed to expose the anode bore 190.

Figure 8:
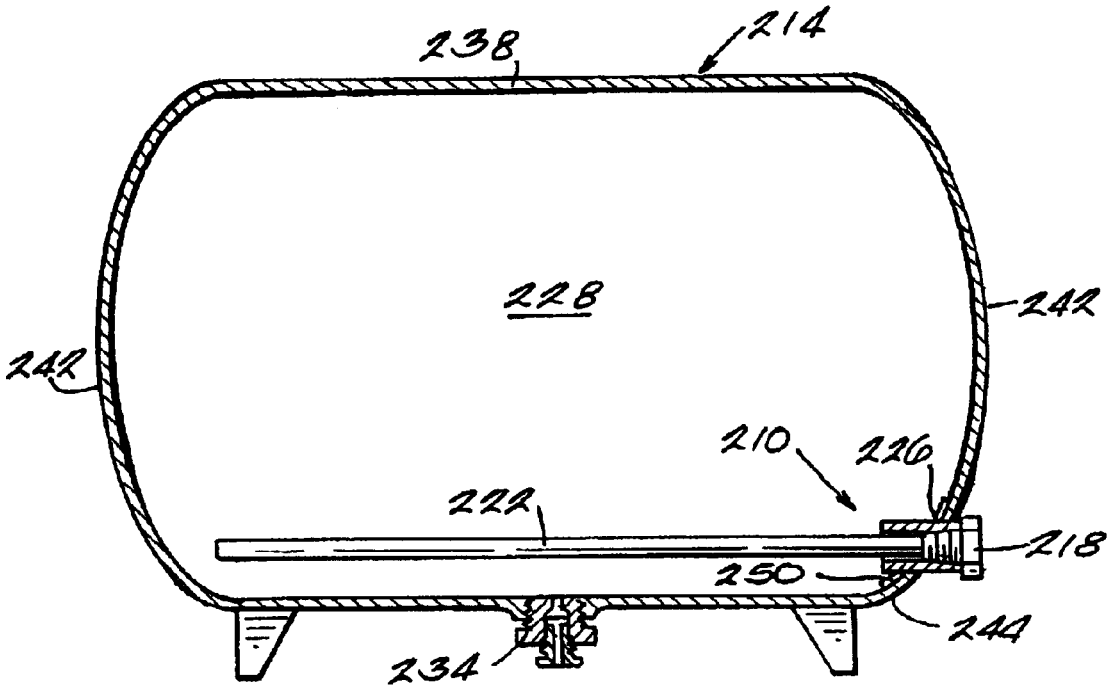
FIG. 8 is a cross-sectional view of a compressor tank showing a third embodiment of a corrosion protection device.
Figure 9:
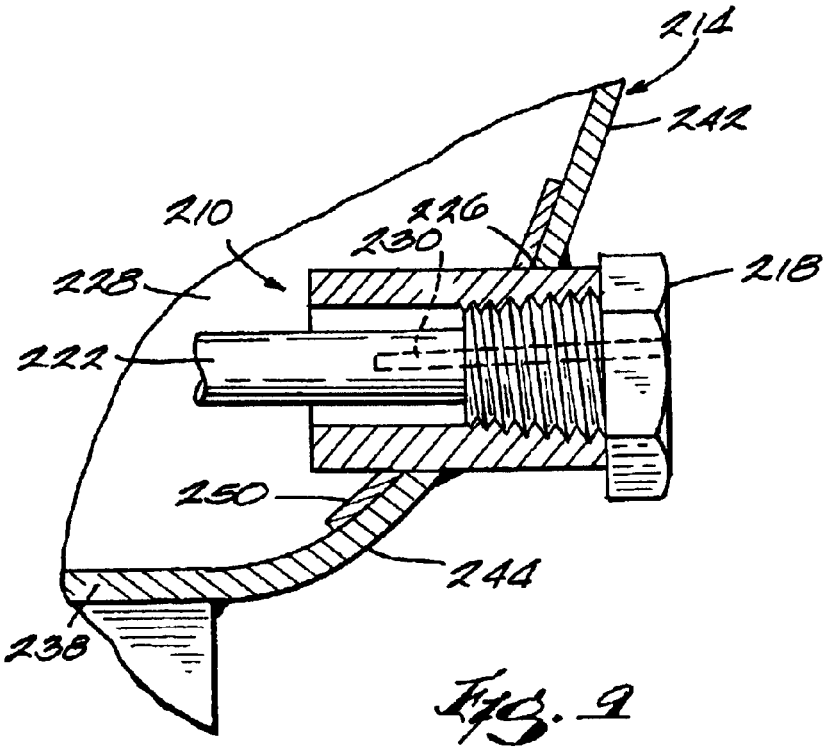
FIG. 9 is an enlarged view of the corrosion protection device of FIG. 8.

A third embodiment of the invention is illustrated in FIGS. 8–9. FIG. 8 illustrates a CPD 210 in a horizontally positioned air compressor tank 214. The CPD 210 includes a plug 218 and an elongated anode 222. The tank 214 has a port 226 disposed in the end of the tank 214, near the bottom of the tank 214. The anode 222 is inserted through the port 226, and the plug 218 threadedly engages the port 226 to seal the tank 214. The tank 214 generally defines an interior volume 228 enclosed within the tank 214.

As mentioned above, the size of the tank 214 affects the design of the CPD 210. A larger tank 214 has more condensation, and a larger steel interior surface area exposed to the moisture. An anode 222 larger than the previously described anodes is needed to prevent corrosion in a larger tank 214. The anode 222 can generally resist corrosion of the steel tank 214 to a distance of about six to eight inches from the anode 222. Therefore, a larger tank 214 requires a larger anode 222 to resist corrosion of the tank 214 near the bottom portion of the tank 214 where condensation generally accumulates.

As illustrated in FIG. 8, the anode 222 may extend nearly the entire length of the tank 214. The anode 222 is a rigid rod and extends near the bottom of the tank 214 to contact condensate accumulated near the bottom of the tank 214. In the illustrated embodiment, the anode 222 does not directly contact the bottom of the tank 214. This gap prevents the electrical currents from short circuiting to the tank 214.

Similar to the previous embodiments, the anode 222 is made from magnesium, or a similar metal having a redox potential lower than iron. The anode 222 may have a core extending through the axial center of the anode 222. The core may be made from an electrically conductive material such as steel that is rigid and has a redox potential higher than the anode 222, or magnesium. The core permits the conductivity of electrons along the length of the anode 222 and helps ensure that the anode 222 is consumed evenly along the length of the anode 222. If the anode 222 is consumed evenly, the anode 222 also helps prevent corrosion of the tank 214 evenly along the length of the anode 222.

As shown in FIG. 9, the CPD 210 has an anode bore 230 that extends into the anode 222 in a generally axial direction. The anode bore 230 extends beyond the threaded portion of the plug 218 into the anode 222, and the anode bore 230 is exposed to the outside atmosphere. After the anode 222 is consumed, the anode bore 230 is exposed to the interior volume 228 of the tank 214. As described above, the condensate and pressurized air within the tank 214 may then exit the tank 214 through the anode bore 230.

The CPD 210 of the third embodiment, illustrated in FIGS. 8–9, functions very similarly to the previously described embodiments. These embodiments use the anode 222 and cathodic corrosion protection to relieve accumulated condensate and inhibit corrosion of the tank 214. The electrochemical process involving the anode 222 and the tank 214 in this embodiment will be similar to the other embodiments described above.

The anode 222 is made from a material having a redox potential lower than the redox potential of iron, and the anode 222 is preferably made from magnesium. Similar to the first embodiment, the CPD 210 is disposed near the bottom of the tank 214 where moisture generally collects. As condensate collects and contacts the tank 214 and anode 222, a galvanic circuit is formed, and electrons are transferred from the anode 222 to hydrogen in the water. Since the anode 222, plug 218, and tank 214 are all coupled in an electrically conductive relationship, the water will first take electrons from the source that provides the electrons with the least resistance.

The anode 222 provides electrons with less resistance than the tank 214 or plug 218, because the anode 222 is more active and has a lower redox potential than the tank 214 or plug 218. Therefore, the anode 222 may provide electrons and corrode before the tank 214 begins to lose electrons and corrode. If the anode 222 continues to corrode and lose electrons, it will eventually become consumed, or corroded to the point where the anode bore 230 is exposed to the interior volume 228 of the tank 214, and the anode bore 230 is in fluid flow communication with the interior volume 228. FIGS. 8–9 illustrate the CPD 210 with a new unconsumed anode 222.

Once the anode 222 is consumed, the moisture and condensate within the tank 214 may be forced out of the tank 214 through the anode bore 230. As described above, the pressure within the tank 214 forces the moisture and condensate through the anode bore 230 and out of the tank 214.

The anode 222 and anode bore 230 automatically release the moisture after enough condensate has accumulated to consume the anode 222. Condensate and air discharged through the anode bore 230 will create a tell-tale noise that a person can identify. The tell-tale noise indicates that the machine should be shut down because the compressor tank 214 will no longer function effectively with the pressure being relieved. The plug 218 can then be removed from the tank opening 226, and the CPD 210 with the consumed anode 222 may be taken out of the tank 214. A CPD 210 with a new anode 222 may then be placed into the tank 214 as the plug 218 is reinserted back into the tank opening 226 to reseal the tank 214.

As mentioned above, a feature of the CPD 210 is to prevent tank failures caused by corrosion of the tank walls while the contents of the tank 214 are under pressure. Since the anode 222 may be consumed before the tank 214 corrodes, the condensate and pressure is discharged through the anode bore 230 before the tank 214 may corrode enough to cause a rupture. Therefore, the pressure within the tank 214 is released through the anode bore 230 and the tank 214 may not rupture after the anode 222 is consumed to expose the anode bore 230.

As shown in FIG. 8, this embodiment has a separate CPD 210 and let down valve 234. The let down valve 234 may be any conventional let down valve, relief valve or blow down valve, and is periodically opened to drain moisture from the tank 214. In the illustrated embodiment, the let down valve 234 is similar to the let down valve 146 shown in FIGS. 5–6. However, in FIG. 8, the let down valve 234 is separate from the anode 222, and the anode 222 is interconnected to the tank 214 with a separate plug 218.

As shown in FIGS. 8–9, the tank 214 has a elongated cylindrical shell portion 238 and two curved end portions 242. The area where the ends 242 join the cylindrical shell portion 238 is called the "knuckle" 244, and is generally the most highly stressed area of the tank 214. In the illustrated embodiment, the port 226 is disposed near the knuckle 244. To help relieve the stress concentration at the knuckle 244, a reinforcing plate 250 surrounds the port 226, and is interconnected to the tank 214 and the port 226. The reinforcing plate 250 may be welded to the tank 214 from the inside of the tank 214 to help prevent the collection of condensation and potential corrosion between the reinforcing plate 250, the tank 214 and the port 226.

Figure 10:
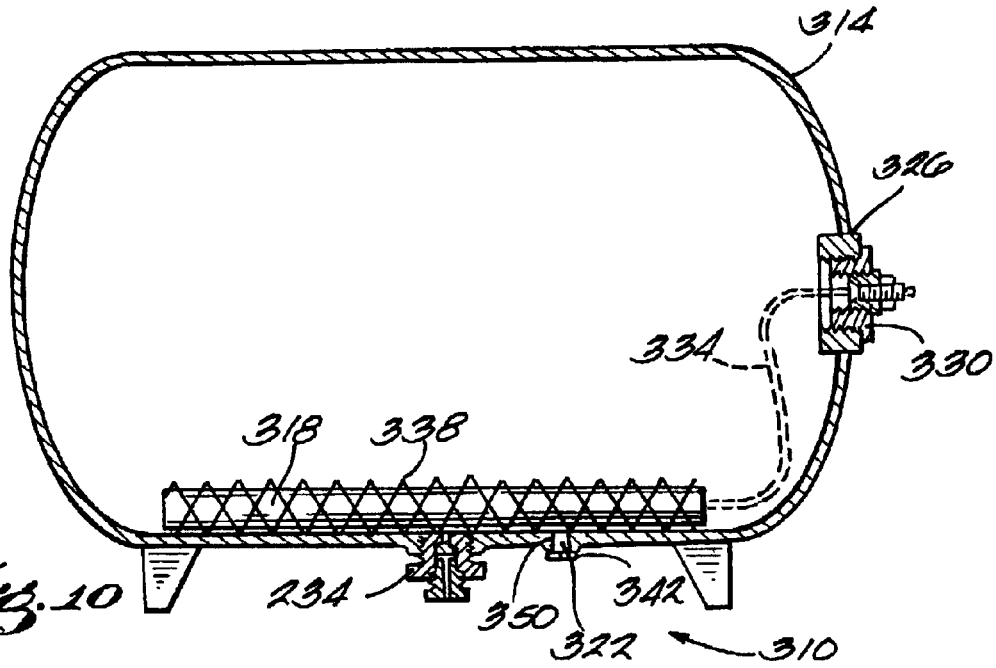
FIG. 10 is a cross-sectional view of a compressor tank showing a fourth embodiment of a corrosion protection device.
Figure 12:
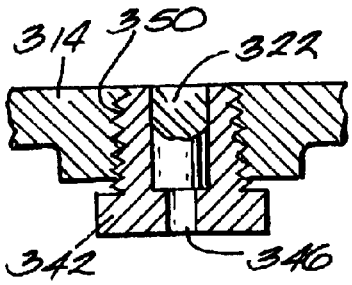
FIG. 12 is an enlarged view of the tell-tale anode of FIG. 10.
Figure 11:
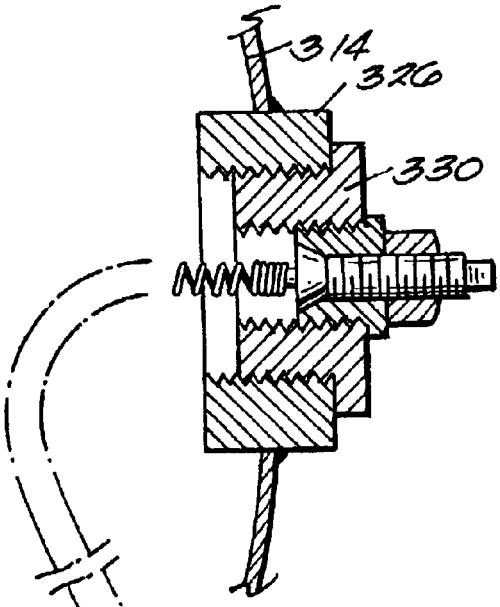
FIG. 11 is an enlarged view of the corrosion protection device of FIG. 10.
Figure 11:
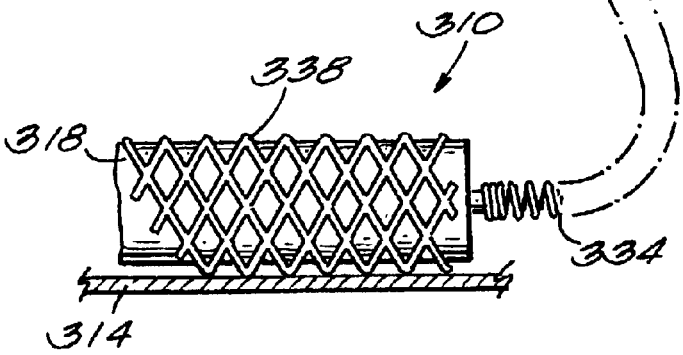

FIGS. 10–12 illustrate a fourth embodiment of the invention having a CPD 310 for preventing corrosion of an air compressor tank 314. As shown in FIG. 10, the CPD 310 has both an anode rod 318 and a separate smaller tell-tale anode 322. The primary function of the anode rod 318 is to prevent corrosion of the tank 314. The primary function of the tell-tale anode 322 is to corrode at approximately the same rate as the anode rod 318 and to release the tank's air pressure when the anode 322 in the tell-tale has been consumed.

The tank 314 has a port 326 located near the center of an end of the tank 314. A plug 330 is inserted into the port 326 to seal the tank 314. The plug 330 is preferably made from brass, or a similar electrically conductive material, and is coupled to the tank 314 in an electrically conductive relationship. The anode rod 318 is interconnected to the plug 330 in an electrically conductive relationship through a wire 334. In the illustrated embodiment, the wire 334 is a stainless steel spring that is interconnected to both the plug 330 and the anode rod 318. Alternatively, the wire 334 could be a conventional wire, or any other similar flexible electrically conductive member.

The anode rod 318 extends along the bottom of the tank 314 to prevent the tank 314 from corroding. The anode rod 318 is made from a material having a lower redox potential than iron, and is preferably made from magnesium. As described above, when condensate collects near the bottom of the tank 314 and contacts both the anode rod 318 and the tank 314, the magnesium anode rod 318 will lose electrons before the steel tank 314 will lose electrons. Similar to the previous embodiment, the anode rod 218 of this embodiment may have a core that extends axially through the center of the anode rod 218. The core may be made of steel, or a similar electrically conductive material. The core permits the even distribution of electrons, and ensures that the anode rod 318 is consumed evenly along the length of the tank 314.

As shown in FIGS. 10–11, a plastic mesh 338 surrounds the anode rod 318. The plastic mesh 338 prevents the anode rod 318 from directly contacting the tank 314 so that electrical currents will not short circuit to the tank 314, but will flow through the wire 334 between the anode rod 318 and the electrical connection to the port 326. The plastic mesh 338 is made from a flexible plastic material that is not electrically conductive, and can withstand relatively high temperatures. Temperatures within an air compressor tank may reach as high as 400 degrees Fahrenheit. The plastic mesh 338 insulates the anode rod 318 from direct contact with the tank 314, but permits condensate to contact the anode rod 318 and create a galvanic circuit between the moisture, anode rod 318 and tank 314. Alternatively, nylon rings may be used to surround the anode rod 318 and separate the anode rod 318 from the tank 314.

As described above, the CPD 310 in this embodiment has the separate tell-tale anode 322 and anode rod 318. The anode rod 318 prevents corrosion of the tank 314, and is significantly larger than the tell-tale anode 322. As shown in FIG. 12, the tell-tale anode 322 is dispose within a tell-tale plug 342. The tell-tale plug 342 has a relief passage 346 that is exposed to the outside atmosphere. The tell-tale plug 342 is made from brass, or a similar electrically conductive material. The tank 314 has a tell-tale port 350 near the bottom of the tank 314. The tell-tale plug 342 is inserted into the tell-tale port 350 to seal the tank 314.

The tell-tale anode 322 is located near the bottom of the tank 314 where condensate collects. As condensate collects and contacts the tell-tale anode 322 and anode rod 318, a galvanic circuit is formed, and electrons are transferred from the anodes 318, 322 to hydrogen in the water. Since the anodes 318, 322 and tank 314 are all coupled in an electrically conductive relationship, the water will first take electrons from the source that provides the electrons with the least resistance.

The anodes 318, 322 provide electrons with less resistance than the tank 314, because the anodes 318, 322 are more active and have a lower redox potential than the tank 314. Therefore, the anodes 318, 322 may lose electrons and corrode before the tank 314 begins to lose electrons and corrode. The anodes 318, 322 use cathodic corrosion protection to help prevent the tank 314 from corroding. If the anodes 318, 322 continue to corrode and lose electrons, the tell-tale anode 322 will eventually become consumed, or corroded to the point where the relief passage 346 is exposed and in fluid flow communication with the interior volume of the tank 314.

Once the tell-tale anode 322 is consumed and the relief passage 346 is exposed, the condensate within the tank 314 may be forced out of the tank 314 through the relief passage 346. As described above, the pressure within the tank 314 forces the condensate through the relief passage 346 and out of the tank 314. The tell-tale anode 322 and relief passage 346 automatically release the condensate after enough condensate has accumulated to consume the tell-tale anode 322.

Condensate and air being discharged through the relief passage 346 create a tell-tale noise that a person can identify. The tell-tale noise indicates that the machine should be shut down because the compressor tank 314 will no longer function effectively with the pressure being relieved. The tell-tale plug 342 and the consumed tell-tale anode 322 can then be removed from the tell-tale port 350. The anode rod 318 is also be removed from the tank 314. New anodes 318, 322 may then be placed into the tank 314 as the plugs 330, 342 are reinserted back into the respective ports 326, 350 to reseal the tank 314.

In the illustrated embodiment, the anode rod 318 and the tell-tale anode 322 are calibrated to be consumed, or fully corroded after a similar period of time. Generally, when the tell-tale anode 322 is consumed, it will indicate that the anode rod 318 has been consumed. Since the tell-tale anode 322 is smaller than the anode rod 318, the consumption rate of the tell-tale anode 322 must be slowed to last approximately as long as the anode rod 318. In the illustrated embodiment, both anodes 318, 322 are made from magnesium. A compound, such as an RTV adhesive sealant may be placed between the magnesium tell-tale anode 322 and the brass tell-tale plug 342. The compound may retard corrosion rate and the loss of electrons of the tell-tale anode 322, and extend the life of the tell-tale anode 322 to approximate the life of the anode rod 318.

As illustrated in FIG. 10, the tank 314 has a let down valve 234 that may be any conventional let down valve, relief valve or blow down valve. The let down valve 234 is periodically opened to drain condensate from the tank 314. The let down valve 234 is similar to the let down valve 234 described above and illustrated in FIG. 8.

Figure 12A:
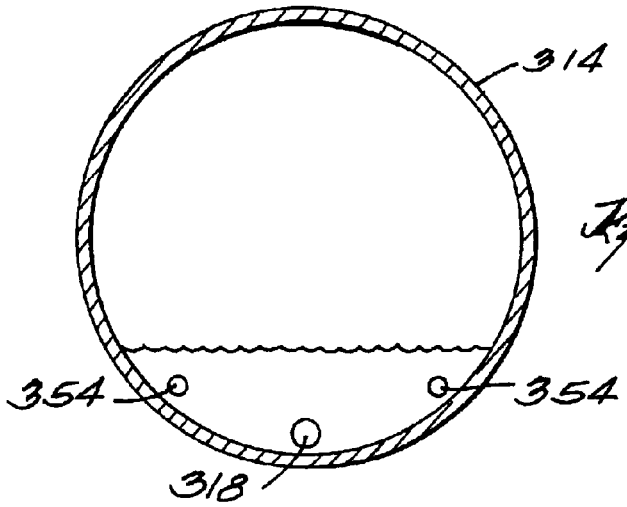
FIG. 12A is a cross-sectional view of a compressor tank showing an alternate embodiment of a corrosion protection device.
Figure 12B:
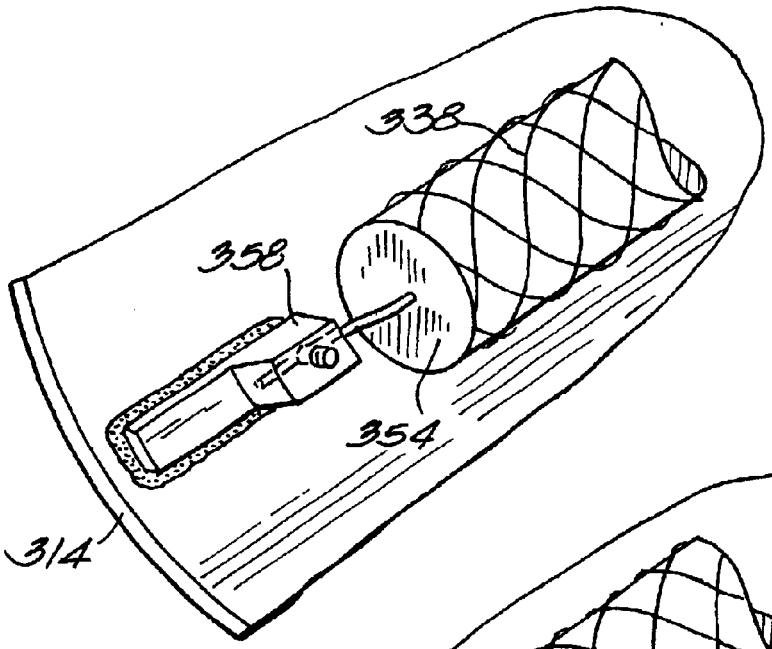
FIG. 12B is an enlarged view of the corrosion protection device of FIG. 12A
Figure 12C:
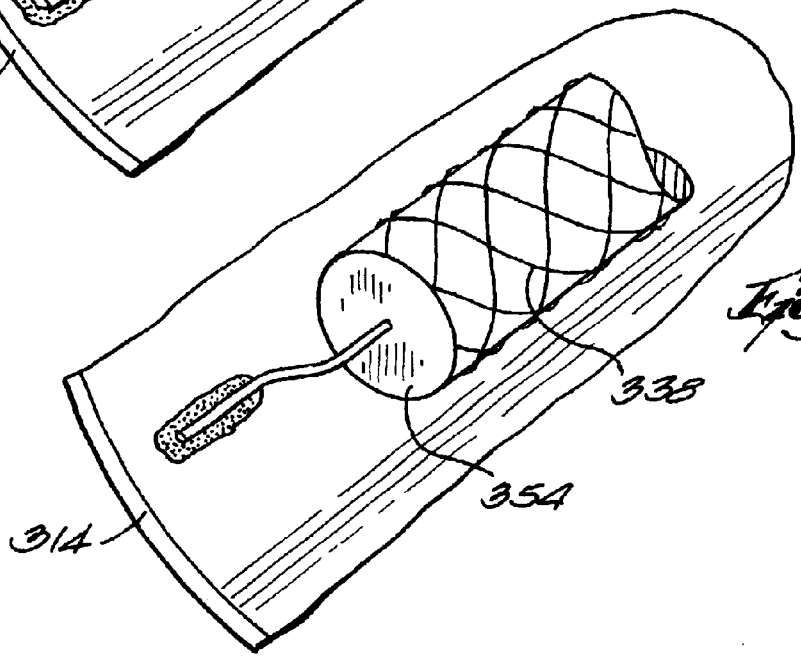
FIG. 12C is an enlarged view of the corrosion protection device of FIG. 12A.

For very large tanks of 24 to 30 inches in diameter, it may be necessary to have secondary anodes 354 in these tanks to provide corrosion protection. As shown in FIG. 12A, these secondary anodes 354 would be used when the condensate level was high enough to immerse them under the condensate. These secondary anodes 354 can be installed during the fabrication of the tank 314, and placed in parallel approximately 6 to 8 inches from the primary anode 318. In FIG. 12C, these secondary anodes 354 are also covered with plastic mesh 338, and can be electrically connected to the tank 314 by welding the core of the anodes 354 to the steel tank 314. As shown in FIG. 12B, an alternative attachment is to first weld a terminal lug 358 to the tank wall and then screw the core of the secondary anode 254 to the lug 358. The advantage of the attachment shown in FIG. 12B is that welding close to the combustible magnesium is eliminated.

Figure 14:
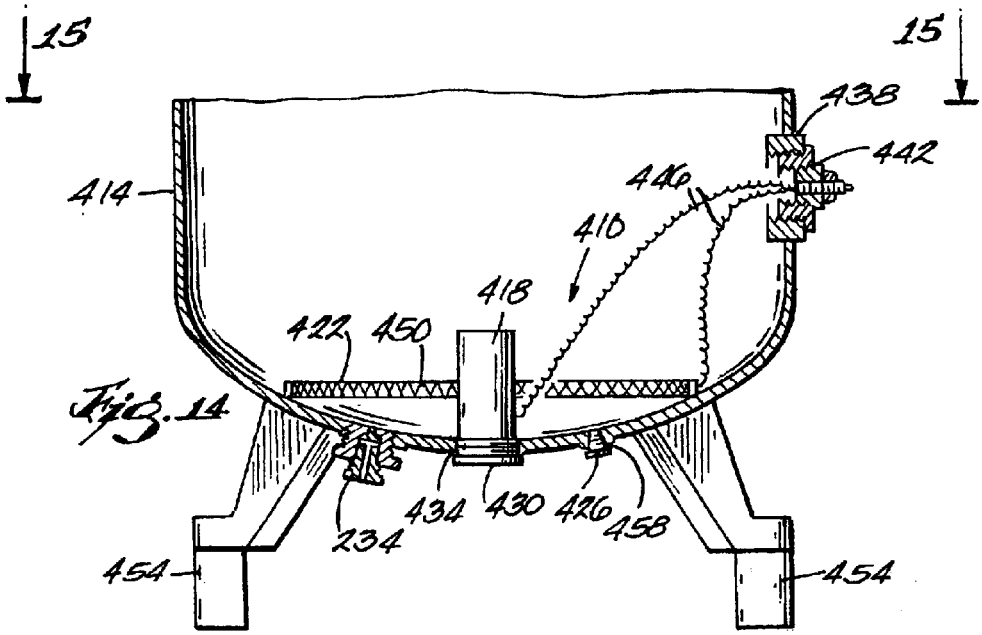
FIG. 14 is an enlarged cross-sectional view of the tank of FIG. 13.
Figure 15:
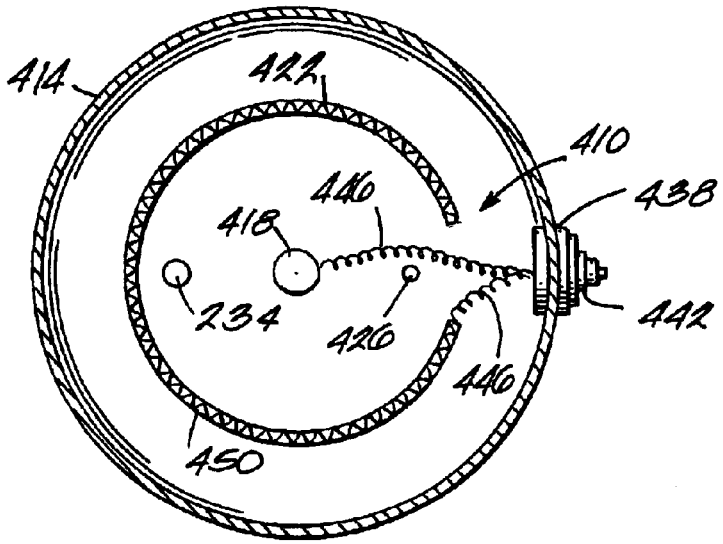
FIG. 15 is a cross-sectional view taken along line 15—15 of FIG. 14.

FIGS. 13–15 illustrate a fourth embodiment of the invention having a CPD 410 for preventing corrosion of an air compressor tank 414. As shown in FIG. 13, the CPD 410 has an anode cylinder 418, an anode coil 422, and a separate tell-tale anode 426. The anode cylinder 418 and anode coil 422 help prevent corrosion in the tank 414. The tell-tale anode 426 indicates when an excessive amount of condensate has accumulated within the tank 414, and releases the condensate and pressure to the outside atmosphere after the tell-tale anode 426 is consumed.

In the illustrated embodiment, the anode cylinder 418 is interconnected to a plug 430 in an electrically conductive relationship. Similar to the previously described anodes, the anode cylinder 418 is made from a material having a lower redox potential than iron, such as magnesium. As shown in FIG. 14, the tank 414 has a port 434 near the bottom of the tank 414. The anode cylinder 418 is inserted through the port 434, and the plug 430 threadedly engages the port 434 to seal the tank 414. The plug 430 is made of an electrically conductive material, such as brass.

As described above, the anode cylinder 418 can prevent corrosion of the steel tank 414 within a limited area surrounding the anode cylinder 418. If the tank 414 is relatively small, the anode cylinder 418 may be sufficient to effectively protect the tank 414 from corrosion. If the tank 414 is relatively large, additional anodes spaced along the bottom of the tank 414 may be required to prevent corrosion. As shown in FIGS. 13–15, the anode coil 422 is a rigid, elongated, semi-circular shaped member, and is made from a material having a lower redox potential than iron, such as magnesium. As described above, the anode coil 422 may have a core made from an electrically conductive material to evenly distribute electrons and ensure even consumption of the anode coil 422.

The tank 414 has a main port 438 located on the side cylindrical shell portion of the tank 414. The main port 438 is an aperture in the tank 414, and the anode coil 422 may be inserted into the tank 414 through the main port 438. In the illustrated embodiment, the anode coil 422 is not a complete circle to permit the anode coil 422 to be inserted through the main port 438.

A main plug 442 is inserted into the main port 438 to seal the tank 414. The main plug 442 is made from an electrically conductive material, such as brass, and threadedly engages the main port 438 in an electrically conductive relationship. Similar to the previously described embodiment, the anode coil 422 is interconnected to the main plug 442 in an electrically conductive relationship through a wire 446. In the illustrated embodiment, the wire 446 is a stainless steel spring, but, as described above, the wire 446 could also be a conventional wire, or other similar flexible electrically conductive member.

As shown in FIGS. 13–17, a plastic mesh 450, surrounds the anode coil 418, similar to the previously described embodiment. The plastic mesh 450 insulates the anode coil 422 from direct contact with the tank 414, but permits condensate to contact the anode coil 422 and create a galvanic circuit between the condensate, anode coil 422 and tank 414. The plastic mesh 450 is made from a material that is not electrically conductive, and can withstand relatively high temperatures. Alternatively, nylon rings may be used to surround the anode coil 422 and separate the anode coil 422 from the tank 414.

As describe above, the anode cylinder 418 is inserted into the tank 414 through the port 434, and is interconnected to the plug 430. In this arrangement, replacing the anode cylinder 418 requires access to the bottom of the tank 414. To gain access to the bottom of the tank 414, it is often necessary to lay the tank 414 down on its side, and then right it again. This may require disconnecting electrical and pneumatic lines and relubricating the compressor before putting it back in service. As shown in FIGS. 13–14, the tank 414 may have legs 454 that extend the tank 414 further vertically, and provide additional clearance for access to the bottom of the tank 414.

Alternatively, the anode cylinder 418 may be inserted into the tank 414 through the main port 438. This eliminates the need for access to the bottom port 434. In this configuration, the anode cylinder 418 may be covered with a plastic mesh to separate the anode cylinder from the tank 414. The anode cylinder 418 may be electrically interconnected to the main plug 422 through the wire 466, as shown in FIGS. 13–15. This electrical connection completes the galvanic circuit.

As shown in FIGS. 13–15, the tank 414 has the tell-tale anode 426 located near the bottom of the tank 414. Similar to the previous embodiment, the anode cylinder 418 and anode coil 422 help prevent corrosion of the tank 414, and the tall-tale anode 426 indicates when the anodes 418 and 422 have been consumed. The tell-tale anode 426 illustrated in FIGS. 13–15 is similar to the tell-tale anode 322 illustrated in FIG. 12, and described above. The tell-tale anode 426 is calibrated to be consumed after approximately the same period of time as the anode cylinder 418 and anode coil 422. Since the tell-tale anode 426 is smaller than the anode cylinder 418 and anode coil 422, the corrosion rate of the tell-tale anode 426 must be slowed so the anodes 418, 422, and 426 are all consumed after approximately the same period of time.

As described above, the tell-tale anode 426 may be made of the same material as the anode cylinder 418 and anode coil 422, such as magnesium. A compound may be inserted between the tell-tale anode 426 and an anode plug 458 to retard the transfer of electrons and slow the corrosion rate of the tell-tale anode 426. Alternatively the tell-tale anode 426 could be made of a material that has a redox potential between the redox potential of magnesium and iron, such as aluminum. An aluminum tell-tale anode 426 would lose electrons and corrode slower than a magnesium anode block 418 and anode coil 422, but faster than a steel tank 414. The tell-tale anode 426 could then be calibrated to be consumed after approximately the same period of time as the anode cylinder 418 and anode coil 422.

As illustrated in FIGS. 13–15, the tank 414 also has a let down valve 234 that may be any conventional let down valve, relief valve or blow down valve. The let down valve 234 is periodically opened to drain condensate from the tank 414. The let down valve 234 is similar to the let down valve 234 described above and illustrated in FIG. 8.

Figure 16:
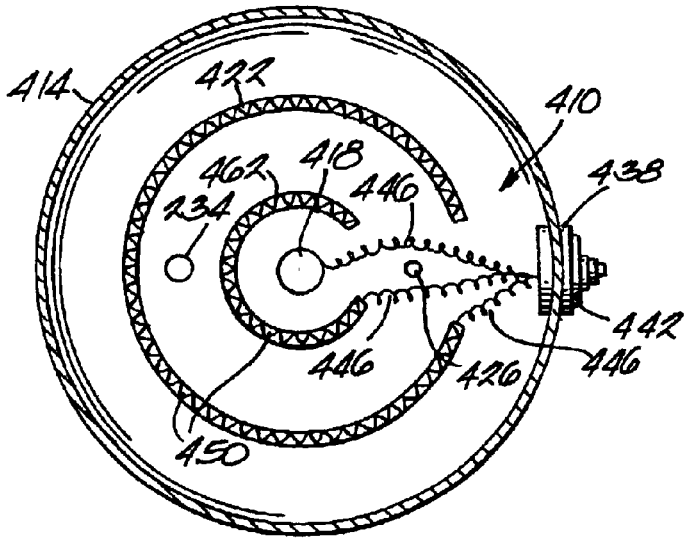
FIG. 16 is a cross-sectional view showing another embodiment of a corrosion protection device.

FIG. 16 illustrates another embodiment of the invention for a vertically positioned air compressor tank 414. The embodiment illustrated in FIG. 16 is similar to the embodiment illustrated in FIGS. 13–15, except that the CPD 410 includes a second anode coil 462. The second anode coil 462 may be used to provide additional corrosion protection for the tank 414, or may be used to protect a greater surface area of a larger tank. As illustrated in FIG. 16, the second anode coil 462 is similar to the anode coil 422, but has a different diameter than the anode coil 422. The anode coil 422 and second anode coil 462 with different diameters distribute corrosion protection over a greater area.

Alternatively, the CPD 410 may not have the anode block 418, and only the anode coil 422 and second anode coil 462 could be used to prevent corrosion of the tank 414. The optimal arrangement of anodes will depend on the size and dimensions of the tank 414. As mentioned above, an anode may help prevent corrosion to a distance of about six to eight inches from the anode. The anodes should be spaced apart to maximize corrosion protection.

The second anode coil 462 also has a plastic mesh 450 separating the second anode coil 462 from the tank 414, and is interconnected to the main plug 442 through the wire 446 in an electrically conductive relationship. FIG. 16 also shows the tell-tale anode 426 and the let down valve 234, which are described above in more detail.

Figure 17:
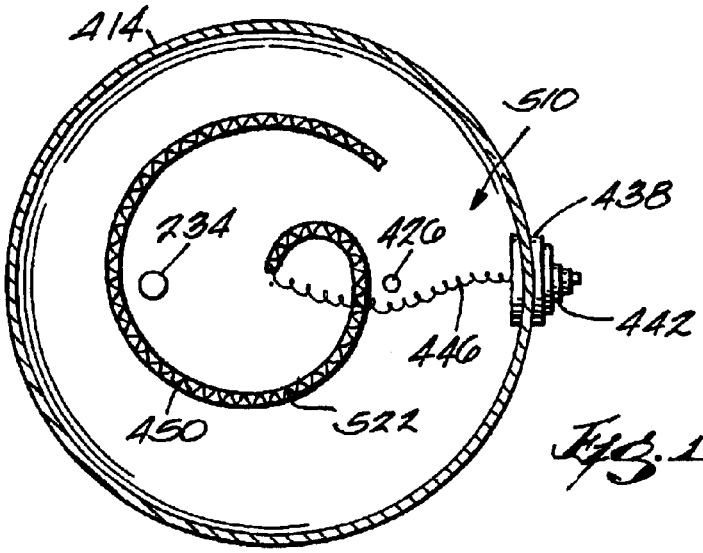
FIG. 17 is a cross-sectional view showing another embodiment of a corrosion protection device.

FIG. 17 illustrates an additional embodiment of a CPD 510 for a vertically positioned air compressor tank 414. The CPD 510 includes a spiral anode 522 and a tell-tale anode 426. The spiral anode 522 is similar to the anode coil 422 described above, but the spiral anode 522 has a spiral shape instead of a semi-circular shape. As described above, an anode can prevent corrosion of a tank 414 within an effective distance from the anode. The spiral shape allows the spiral anode 522 to spread out along the bottom of the tank 414, and cover a sufficient area to provide corrosion protection for the tank 414. The spiral shape also allows the spiral anode 522 to be inserted into the tank 414 through the main port 438, so an additional port and access to the bottom of the tank 414 is not needed.

The spiral anode 522 also has a plastic mesh 450 separating the spiral anode 522 from the tank 414, and is interconnected to the main plug 442 through the wire 446 in an electrically conductive relationship. FIG. 17 also shows the tell-tale anode 426 and the let down valve 234, which are described above in more detail.

What is claimed is:

1. A pressure vessel comprising:

a tank having a tank wall and including a tank opening in the tank wall, the tank wall defining an enclosed interior volume;

a corrosion protection device removably positionable in the tank opening to seal the tank, the corrosion protection device including a plug and an anode, the plug coupled to the tank in an electrically conductive relationship, the anode coupled to the plug in an electrically conductive relationship, such that when the plug is positioned in the tank opening the anode is exposed to the interior volume of the tank; and a passage extending at least partially through the corrosion protection device, the passage in fluid flow communication with the outside atmosphere, the anode disposed between the passage and the interior volume to seal the passage from the interior volume wherein the plug has a let down valve movable between an open position and closed position, and the let down valve may release moisture and pressure from within the tank when the let down valve is in the open position.

2. The pressure vessel of claim 1, wherein the plug is disposed near the bottom of the tank.

3. The pressure vessel of claim 1, wherein the anode corrodes at a faster rate than the tank corrodes.

4. The pressure vessel of claim 1, wherein the anode has a lower redox potential than the tank.

5. The pressure vessel of claim 1, wherein the tank is made of steel.

6. The pressure vessel of claim 1, wherein the anode is made of magnesium.

7. The pressure vessel of claim 1, wherein the anode is made of aluminum.

8. The pressure vessel of claim 1, wherein the plug is screwed into the tank opening with a threaded connection.

9. The pressure vessel of claim 8, wherein the plug is screwed into the tank with a left-hand thread.

10. The pressure vessel of claim 1, wherein the interior volume is in fluid flow communication with the passage after corrosion has consumed a sufficient portion of the anode to expose the passage to the interior volume of the tank.

11. The pressure vessel of claim 1, wherein the passage extends into the anode.

12. The pressure vessel of claim 1, wherein the anode is threadedly engaged with the plug.

13. The pressure vessel of claim 1, wherein a galvanic circuit is formed between the anode, the plug, the tank, and moisture within the tank.

14. A pressure vessel comprising:

a tank having a tank wall and including a tank opening in the tank wall, the tank wall defining an enclosed interior volume;

a corrosion protection device removably positionable in the tank opening to seal the tank, the corrosion protection device including a plug and an anode, the plug coupled to the tank in an electrically conductive relationship, the anode coupled to the plug in an electrically conductive relationship, such that when the plug is positioned in the tank opening the anode is exposed to the interior volume of the tank;

a passage extending at least partially through the corrosion protection device, the passage in fluid flow communication with the outside atmosphere, the anode disposed between the passage and the interior volume to seal the passage from the interior volume;

a port in the tank;

a second plug removably positionable in the port to seal the tank, the second plug made from an electrically conductive material; and a second anode disposed within the tank, wherein the second anode is interconnected to the second plug in an electrically conductive relationship.

15. The pressure vessel of claim 14, further comprising a wire interconnected to the second anode and the second plug, wherein the second anode and second plug are interconnected in an electrically conductive relationship.

16. The pressure vessel of claim 15, wherein the wire is a stainless steel spring.

17. The pressure vessel of claim 15, wherein a mesh at least partially surrounds the second anode, and separates the second anode from direct contact with the tank, the mesh being made from an electrically insulative material.

18. The pressure vessel of claim 14, wherein a galvanic circuit is formed between the second anode, the second plug, the tank, and condensate within the tank.

19. The pressure vessel of claim 14, wherein the second anode corrodes faster than the tank corrodes.

20. The pressure vessel of claim 14, wherein the second anode has a lower redox potential than the tank.

21. The pressure vessel of claim 14, wherein the tank is made of steel.

22. The pressure vessel of claim 14, wherein the anode is made of magnesium.

23. The pressure vessel of claim 14, further comprising a third anode disposed within the tank, wherein the third anode is interconnected, to the second plug in an electrically conductive relationship.

24. A pressure vessel comprising:

a tank defining an enclosed interior volume, the tank haying a main port and a tell-tale port;

a main plug removably positionable in the main port to seal the tank, the main plug coupled to the tank in an electrically conductive relationship;

a primary anode disposed within the tank, and interconnected in an electrically conductive relationship to the main plug; and a tell-tale plug removably positionable in the tell-tale port to seal the tank, the tell-tale plug coupled to the tank in an electrically conductive relationship, the tell-tale plug comprising:

a passage extending at least partially trough the tell-tale plug; and a tell-tale anode coupled to the tell-tale plug in an electrically conductive relationship, the tell-tale anode disposed between the interior volume and the passage, wherein the tell-tale anode is exposed to the interior volume and seals the passage from the interior volume.

25. The pressure vessel of claim 24, wherein the interior volume is in fluid flow communication with to passage after corrosion has consumed a sufficient portion of the tell-tale anode to expose to passage to the interior volume of the tank.

26. The pressure vessel of claim 24, wherein the primary anode is interconnected to the main plug in an electrically conductive relationship through a wire.

27. The pressure vessel of claim 26, wherein the wire is a stainless steel spring.

28. The pressure vessel of claim 24, wherein a mesh at least partially surrounds the primary anode, and separates the primary anode from direct contact with the tank, the mesh being made from an electrically insulative material.

29. The pressure vessel of claim 24, wherein a first galvanic circuit is formed between the primary anode, the main plug, the tank, and condensate within the tank; and a second galvanic circuit is formed between the tell-tale anode, the tell-tale plug, the tank, and condensate within the tank.

30. The pressure vessel of claim 24, wherein the primary anode and the tell-tale anode corrode at a faster rate than the tank corrodes.

31. The pressure vessel of claim 24, wherein the primary anode and the tell-tale anode have a lower redox potential than the tank.

32. The pressure vessel of claim 24, wherein the primary anode corrodes at a faster rate than the tell-tale anode.

33. The pressure vessel of claim 24, wherein the primary anode has a lower redox potential than the tell-tale anode.

34. The pressure vessel of claim 24, wherein the tank is made of steel.

35. The pressure vessel of claim 24, wherein the primary anode is made of magnesium.

36. The pressure vessel of claim 24, wherein the tell-tale anode is made of magnesium.

37. The pressure vessel of claim 24, wherein a compound is disposed between the tell-tale anode and the tell-tale plug to retard the transfer of electrons between the tell-tale anode and the tell-tale plug.

38. The pressure vessel of claim 24, wherein the tell-tale anode is made of aluminum.

39. The pressure vessel of claim 24, wherein the primary anode is an elongated rod extending along the length of the tank.

40. The pressure vessel of claim 24, wherein the primary cylindrical anode is disposed near the bottom of the tank.

41. The pressure vessel of claim 24, wherein the primary anode is an elongated semi-circular shaped member.

42. The pressure vessel of claim 24, wherein the primary anode is an elongated spiral-shaped member.

43. The pressure vessel of claim 24, further comprising a secondary anode disposed within the tank, wherein the secondary anode is interconnected in an electrically conductive relationship to the main plug through a wire.

44. A corrosion protection device for a pressurized steel tank having a port, the corrosion protection device comprising:

a plug removably positionable in the port to seal the tank, the plug coupled to the tank in an electrically conductive relationship;

an anode coupled to the plug in an electrically conductive relationship, wherein the anode is exposed to the interior volume of the tank when the plug is positioned in the port;

a passage extending through the plug, the passage in fluid flow communication with the outside atmosphere, wherein the anode is disposed between the passage and the interior volume and seals the passage from the interior volume; and a second anode disposed within the tank, wherein the second anode does not directly contact the tank, and the second anode is interconnected in an electrically conductive relationship to the tank and wherein the anode is made from a material that corrodes at a faster rate than the tank corrodes.

45. The corrosion protection device of claim 44, wherein the passage is in fluid flow communication with the interior volume of the tank after corrosion has consumed a sufficient portion of the anode to expose the passage to the interior volume of the tank.

46. The corrosion protection device of claim 44, wherein the anode has a lower redox potential than the tank.

47. The corrosion protection device of claim 44, wherein the anode is made from magnesium.

48. The pressure vessel of claim 44, wherein a mesh at least partially surrounds the second anode, and separates the second anode from direct contact with the tank, the mesh being made from an electrically insulative material.

* * * * *

UNITED STATES PATENT AND TRADEMARK OFFICE

CERTIFICATE OF CORRECTION

PATENT NO. : 6,770,177 B2 
DATED : August 3, 2004
INVENTOR(S) : Charles Tillman Keller and William M. Lewis It is certified that error appears in the above-identified patent and that said Letters Patent is hereby corrected as shown below:

Column 17,
Line 31, replace “claim 15” with -- claim 14 --.
Line 52, replace “haying” with -- having --.

Column 18,
Line 6, replace “to” with -- the --.
Line 8, replace “to”, second occurrence, with -- the --.

Signed and Sealed this

Thirtieth Day of November, 2004

JON W. DUDAS
*Director of the United States Patent and Trademark Office*